United States Patent [19]

Gutknecht et al.

[11] Patent Number: 5,026,260

[45] Date of Patent: Jun. 25, 1991

[54] TURBOCHARGER WITH TURBINE BACKPLATE AND CENTER HOUSING OIL SHIELD

[75] Inventors: Daniel A. Gutknecht, Torrance; I-Chung Ho, Rancho Palos Verdes, both of Calif.

[73] Assignee: Allied-Signal Inc., Morristown, N.J.

[21] Appl. No.: 404,384

[22] Filed: Sep. 8, 1989

[51] Int. Cl.[5] ..... F04B 17/00

[52] U.S. Cl. ..... 417/407; 184/6.11

[58] Field of Search ..... 417/405, 406, 407; 60/605; 184/6.11

[56] References Cited

U.S. PATENT DOCUMENTS

| | | | |
|---|---|---|---|
| 2,646,210 | 7/1953 | Kohlmann et al. | 417/407 |
| 4,256,441 | 3/1981 | Arora | 417/407 |
| 4,364,717 | 12/1982 | Schippers et al. | 417/407 |
| 4,664,605 | 5/1987 | Asano et al. | 417/407 |
| 4,704,075 | 11/1987 | Johnston et al. | 417/407 |
| 4,752,193 | 6/1988 | Hörler | 417/407 |

*Primary Examiner*—Louis J. Casaregola

*Assistant Examiner*—Timothy S. Thorpe

*Attorney, Agent, or Firm*—Ken C. Decker; William N. Antonis

[57] ABSTRACT

A turbocharger includes a backplate separate from both the center housing and the turbine housing which is clamped between the latter by tie bolts extending across the center housing so that the tensile/shear forces transmitted through the head of the tie bolt are taken on the relatively cool compressor side of the center housing. The turbine backplate, since it is a separate member, may be made from a material having a relatively low thermal conductivity, thereby serving as a heat barrier between the turbine section and the center housing of the turbocharger. The separate backplate permits manufacture of the center housing by an inexpensive die casting process. An oil splash shield cooperates with the turbine backplate to prevent oil from splashed against the warm parts of the assembly, and also cooperates with the turbine backplate to define a chamber therebetween that also further increases thermal insulation of the center housing from the relatively warm turbine housing.

8 Claims, 1 Drawing Sheet

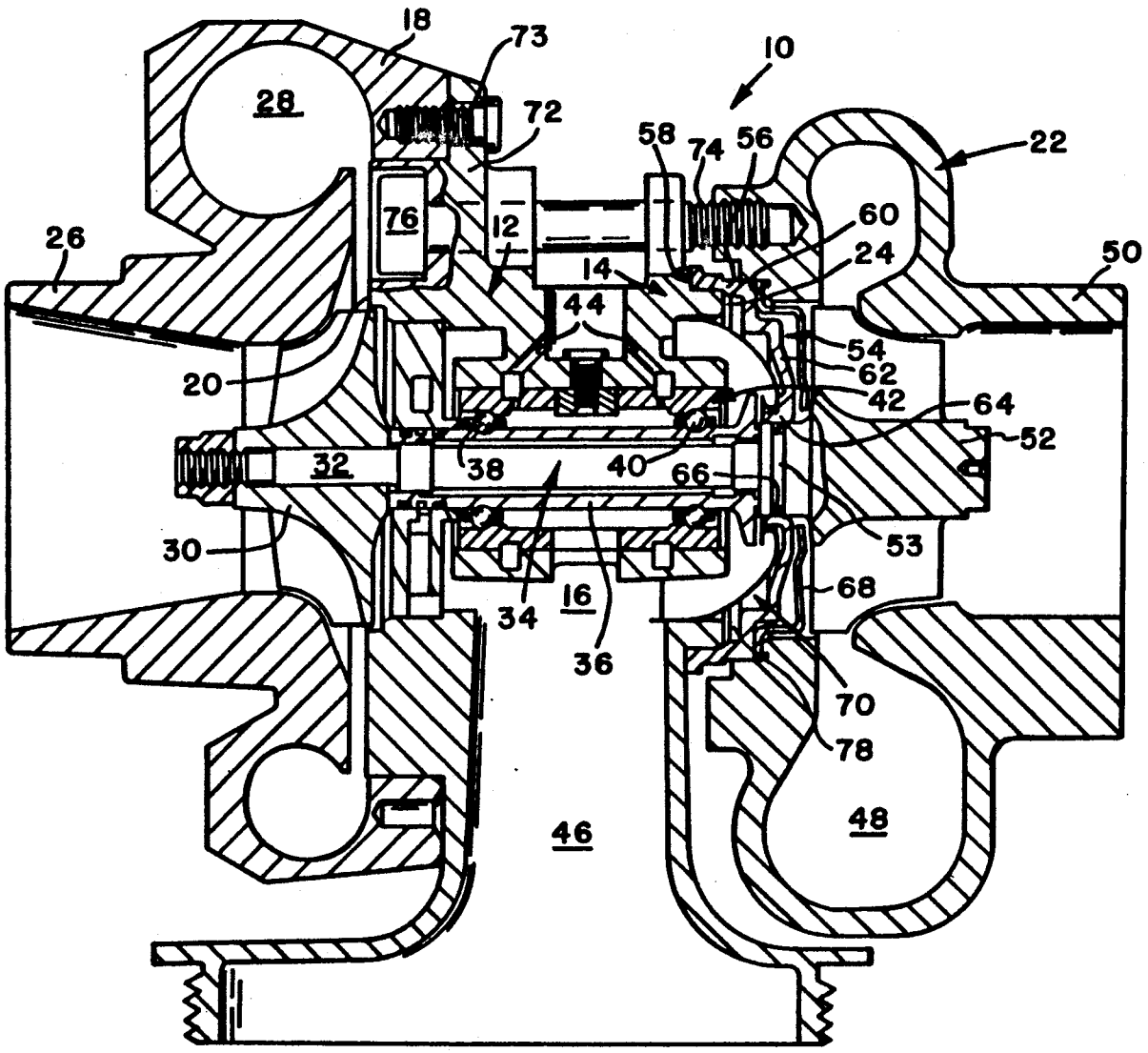
10
12
14
16
18
20
22
24
26
28
30
32
34
36
38
40
42
44
46
48
50
52
53
54
56
58
60
62
64
66
68
70
72
73
74
76
78

TURBOCHARGER WITH TURBINE BACKPLATE AND CENTER HOUSING OIL SHIELD

This invention relates to exhaust gas driven turbochargers for internal combustion engines.

Exhaust gas driven turbochargers include rotating components which rotate at very high speeds (often in excess of 100,000 rpm) and, accordingly, require bearings which are lubricated by lubricating oil. Furthermore, the turbine section of such turbochargers are heated by the engine exhaust gases to high temperatures. The high temperatures of the turbine portion of the turbocharger cause heat transfer to the portion of the turbocharger (the center housing) within which the bearings and lubrication system is located. High temperatures in the center housing, particularly immediately after engine shut down stops the flow of lubricating oil to the bearings, cause oxidation of the lubricating oil within the bearings and on the walls of the center housing. Accordingly, it has been customary to water cool center housings. However, water cooling introduces comPlications in the manufacture of the turbocharger, and also requires complicated connections to the engine cooling system. Furthermore, existing turbocharger designs including water jackets for cooling can be manufactured only by relatively complicated sand core casting processes, instead of the more economical die casting processes.

The present invention solves the aforementioned problems by providing a turbine backplate member, which divides the center housing from the turbine housing, as a part separate from either the turbocharger center housing or the turbine housing. This separate part is clamped between these housings when the turbocharger is assembled. Accordingly, the center housing can be made from the more economical die cast process, and the turbine backplate can be made out of a material different from the that from which the turbine housing and the center housing are manufactured. Since this turbine backplate is relatively small, it can be made from more expensive materials having heat transfer properties different from the materials from which the turbine housing and center housing are manufactured. Accordingly, the turbine backplate may be made from materials that are less thermally conductive than are the other materials used in the turbocharger. Accordingly, the turbine backplate acts as a thermal barrier between the turbine housing and the center housing. An oil splash shield is installed between the bearings and the turbine backplate. This oil shield is cooled during operation of the turbocharger by oil splashing against it. After engine shut down, the oil shield acts as an additional barrier to heat transfer. The oil shield cooperates with the turbine backplate to define a chamber therebetween, thereby providing a further thermal insulator between the relatively hot turbine housing and the center housing.

These and other advantages of the invention will become apparent from the following specification, with reference to the accompanying drawings, the sole figure of which is a cross-sectional view of a turbocharger made pursuant to the teachings of the present invention.

Referring now to the drawings, a turbocharger generally indicated by the numeral 10 includes a center housing 12 including a circumferentially extending wall 14 defining a cavity 16 therewithin. A compressor housing 18 is mounted adjacent open end 20 of the center housing 14, and a turbine housing 22 is mounted on opposite open end 24 of the center housing 12.

Compressor housing 18 includes an inlet 26 connected to a supply of filtered ambient air, and further includes a discharge volute 28, which is connected to the engine induction manifold. A compressor wheel 30 is mounted within the housing 18 on one end 32 of a shaft 34 which is pressed into a sleeve 36. Sleeve 36 and shaft 34 are rotatably supported by ball bearings 38, 40 which are mounted in a bearing outer ring 42. Although ball bearings are disclosed, other bearing systems, such as journal bearings, may be used. Lubrication passages 44 communicate lubricating oil through the bearings 38, 40. Lubricating oil may be supplied from the engine lubricating oil system or from an independent system dedicated to the turbocharger and using a separate motor driven pump. Oil is drained through the drain opening 46.

Turbine housing 22 includes an inlet volute 48, which is communicated to the engine exhaust manifold, and an outlet 50, which is communicated with the vehicle exhaust system. A turbine wheel 52 is mounted on end 53 of the shaft 34 which extends into the housing 22. A turbine backplate generally indicated by the numeral 54 divides the turbine housing 22 from the center housing 12. preferably, the turbine backplate 54 is made from a material having a different thermal conductivity than either the turbine housing 22 or the center housing 12 so that the backplate 54 acts as a thermal insulator between the turbine housing 22 and the center housing 12. Turbine backplate 54 includes an axially extending portion 56, which is clamped between the turbine housing 22 and the center housing 12. Axially extending portion 56 is defined between radially extending compressive force transfer surfaces 58, 60. Turbine backplate 54 further includes a radially projection portion 62 which projects from axially extending portion 56 towards the portion 53 of the shaft 34, and terminates in an axially extending portion 64 adjacent the portion 53 which carries a ring 66 which acts as an oil seal to prevent oil from escaping from the center housing 12 into the turbine housing. A conventional shroud 68 is also clamped adjacent the surface 60 and also projects radially towards the portion 53 of shaft 34. A cup-shaped oil splash shield generally indicated by the numeral 70 is mounted in the cavity 16. The splash shield projects axially toward the backplate 62 and radially inwardly toward the axially extending section 64 of the turbine backplate 54. If an independent lubricating system is used, oil is splashed on the shield 70 after engine shutdown, which maintains shield 70 at low temperature.

The center housing 12 includes a radially outwardly projecting flange portion 72 adjacent the end 20 thereof. The compressor housing is attached to the center housing by conventional fasteners 73 which extend through the flange portion 72. The turbine housing 22 is secured to the center housing 12 by tie bolts 74 which extend through the radially projecting flange portion 72 and threadly engage the turbine housing 22. The head 76 engages the flange portion 72.

In operation, exhaust gases communicated into the inlet volute 48 pass through the turbine wheel 52 and are discharged into the engine exhaust system through the outlet 50, thereby causing the turbine wheel 52 to rotate the shaft 34 at a relatively high speed. Rotation of the shaft 34 rotates the compressor wheel 30, thereby compressing air drawn into the turbocharger through the inlet 26 and discharging compressed air through the outlet volute 28 into the engine intake manifold. Since the exhaust gases passing through the turbine wheel 52 are often extremely hot, it will become apparent that the turbine housing 22, and that portion of the center housing 12 adjacent to the turbine housing 22, will be heated to a relatively high temperature. This temperature will increase even further during "heat soak" conditions after engine shut down, because lubricating oil is then no longer communicated through the passages 44, so that the turbocharger will be without the cooling effect of this lubricating oil. Accordingly, temperatures in the turbine housing 22 and adjacent portions of the center housing 12 often become heated to a temperature sufficient to cause the residual oil remaining in certain areas of the center housing of the turbocharger after engine shut down to "coke", that is, the oil carbonizes in the bearing 40 adjacent the turbine housing 22 and on the surfaces of the center housing adjacent the turbine housing 22. In the present invention, the turbine backplate 62, since it is a separate member from either the turbine housing 22 or the center housing 12, is made from a material having a different thermal conductivity than either the housing 22 or the housing 12. AccordinglY, the backplate 54, in cooperation with the conventional shroud 68, serves to partially restrict transfer of thermal energy from the relatively hot turbine section of the turbocharger into the center housing.

The oil splash shield 70 substantially prevents oil from being splashed against turbine backplate 54 and the other relatively warm areas of the center housing 12 adjacent the turbine housing 22. The splash shield 70 cooperates with the backplate 54 to define a chamber 78 therebetween, which acts a further thermal insulator between the relatively hot turbine section of the turbocharger and the portions of the center housing adjacent the turbine section, which contain the critical bearing 40, which must be kept below a temperature that would cause the lubricating oil remaining in the center housing to coke. The splash shield 70 is kept cool during normal operation of the turbocharger by the lubricating oil which is splashed against the oil shield 70. The fact that the oil shield and turbine backplate 54 are separate members permits the center housing 12 to be manufactured by die casting processes, since the center housing need not be cored as would otherwise be necessary in prior art turbochargers in which the turbine backplate 62 is an integral part of the center housing.

The clamping forces which hold the backplate 54 in place between the turbine housing 22 and the center housing 12 are generated by the tie bolt 74. It will be noted that the flange 72 engages the head 76 of the bolt as on the end of the center housing 12 adjacent the relatively cool compressor housing 18. Accordingly, the tensile and shear forces required to clamp the housings 12 and 22 and the backplate 54 together are taken on the relatively cool projecting portion 72, while the hot portions of the turbine housing 22 adjacent the turbine wheel 52 and the adjacent portions of the turbine backplate 54 and the center housing 12 take only compressive forces. This is desirable because the portion of the circumferentially extending wall 14 of the center housing 12 taking the compressive shear forces is more likely to fail if it is placed in tension prior to being heated to a relatively high temperature.

We claim:

1. A turbocharger comprising a center housing, a compressor housing, and a turbine housing, means for securing the turbine housing and the compressor housing to the center housing, said center housing including a circumferentially extending wall defining a cavity therewithin, means carried by the center housing for rotatably supporting a shaft in said cavity, said shaft including portions extending into the compressor housing and into the turbine housing, a turbine wheel mounted on the portion of the shaft in the turbine housing, a compressor wheel mounted on the portion of the shaft in the compressor housing, said cavity having opposite ends facing said turbine and compressor housings respectively, said end facing said turbine housing being an open end, and an annular backplate member separate from said center housing and from said turbine housing, said annular backplate member circumscribing said shaft for closing said open end of the center housing, said securing means including fastening means extending between the center housing and the turbine housing, said backplate member including a portion clamped between the center housing housing and the turbine housing by compressive forces generated by said fastening means and transmitted from the turbine housing to the compressor housing through said portion of the backplate member, and a circumferentially extending shroud between said annular backplate member and said turbine wheel.

2. Turbocharger as claimed in claim 1, wherein said annular backplate member is made from a material different from the material from which the center housing is made, the thermal conductivity of the material from which the annular backplate member is made being different than that of the material from which the center housing is made whereby the annular backplate member retards transfer of heat from the turbine housing into said cavity.

3. Turbocharger as claimed in claim 2, wherein said rotatably supporting means includes oil lubricated bearings, said center housing including means for communicating lubricating oil to said bearings, and a circumferentially extending oil shield separate from said center housing, said annular backplate member, and the turbine housing and located within said cavity and circumscribing said shaft, said oil shield being circumscribed by said circumferentially extending wall and located between said bearings and said annular backplate member to substantially prevent oil communicated through the bearings from being splashed against the annular backplate member.

4. Turbocharger as claimed in claim 3, wherein at least a portion of the oil shield cooperates with the annular backplate member to define a chamber therebetween within said cavity to thereby isolate said oil shield thermally from said annular backplate member.

5. Turbocharger as claimed in claim 4, wherein said oil shield is maintained at a temperature less than the temperature of the turbine housing and the portion of the center housing adjacent the turbine housing by splashing of the lubricating oil communicated through the bearings against the oil shield.

6. Turbocharger as claimed in claim 1, wherein said rotatably supporting means includes oil lubricated bearings, said center housing including means for communicating lubricating oil to said bearings, and a circumferentially extending oil shield within said cavity circumscribing said shaft and located between said bearings and said annular backplate member to prevent oil communicated through the bearings from being splashed against the annular backplate member.

7. Turbocharger as claimed in claim 1, wherein said annular backplate member includes an axially extending portion and a radially projecting portion extending from said axially extending portion toward said shaft, said axially extending portion defining a pair of axially spaced surfaces engaging respectively the center housing and the turbine housing.

8. Turbocharger as claimed in claim 1, wherein said securing means includes fastening means extending axially across said center housing from the portion of the center housing adjacent said compressor housing to said turbine housing, said fastening means including means for transmitting tensile and/or shear forces to the portion of the center housing adjacent the compressor housing and to isolate the turbine housing and the portion of the center housing adjacent the turbine housing from said tensile and/or shear forces, whereby only compressive forces are transmitted by said securing means to said turbine housing and the portion of the center housing adjacent the turbine housing.

* * * * *